United States Patent [19]

Zeman

[11] Patent Number: 4,619,131

[45] Date of Patent: Oct. 28, 1986

[54] METHOD FOR BENDING SHEETS

[76] Inventor: Hans Zeman, Donaustrasse 23, Maria Enzersdorf-Südstadt, Austria

[21] Appl. No.: 580,773

[22] PCT Filed: Jul. 7, 1980

[86] PCT No.: PCT/AT80/00023

§ 371 Date: Feb. 26, 1981

§ 102(e) Date: Feb. 26, 1981

[87] PCT Pub. No.: WO81/00222

PCT Pub. Date: Feb. 5, 1981

Related U.S. Application Data

[63] Continuation of Ser. No. 243,942, Feb. 26, 1981, abandoned.

[30] Foreign Application Priority Data

Jul. 10, 1979 [AT] Austria ..... 4815/79

[51] Int. Cl.[4] ..... B21D 5/08

[52] U.S. Cl. ..... 72/173; 72/170; 72/168

[58] Field of Search ..... 72/166–168, 72/170–174, 177–182, 366; 29/121.6

[56] References Cited

U.S. PATENT DOCUMENTS

| | | | |
|---|---|---|---|
| 1,354,951 | 10/1920 | Buhtz | 72/168 |
| 1,793,351 | 2/1931 | Bell | 72/168 |
| 2,093,933 | 9/1937 | Sinclair | 72/171 |
| 2,279,197 | 4/1942 | Hoell | 72/171 |
| 2,335,028 | 11/1943 | Rose et al. | 72/171 |
| 3,051,214 | 8/1962 | Rutten | 72/181 |
| 3,073,021 | 1/1963 | Goodwill et al. | 72/366 |
| 3,150,707 | 9/1964 | Howell | 72/179 |
| 3,610,011 | 10/1971 | Valentine | 72/180 |
| 4,154,077 | 5/1979 | Cotter | 72/166 |
| 4,228,672 | 10/1980 | Gale et al. | 72/171 |

FOREIGN PATENT DOCUMENTS

| | | | |
|---|---|---|---|
| 313684 | 2/1974 | Austria | 72/168 |
| 2134036 | 1/1973 | Fed. Rep. of Germany | 72/168 |
| 2506700 | 8/1976 | Fed. Rep. of Germany | 72/168 |
| 16616 | 11/1916 | United Kingdom | 72/168 |
| 519246 | 7/1976 | U.S.S.R. | 72/168 |

*Primary Examiner*—Daniel C. Crane

*Attorney, Agent, or Firm*—Murray Schaffer

[57] ABSTRACT

In a process of bending sheet metal elements having a sectional shape which is continuous in one direction, longitudinal beads are formed or existing beads are enlarged in the sheet element as it is bent at least in the region in which the bending results in an upsetting of material, i.e., in the region in which the sheet metal element is subjected to compressive stress.

2 Claims, 5 Drawing Figures

Fig.4
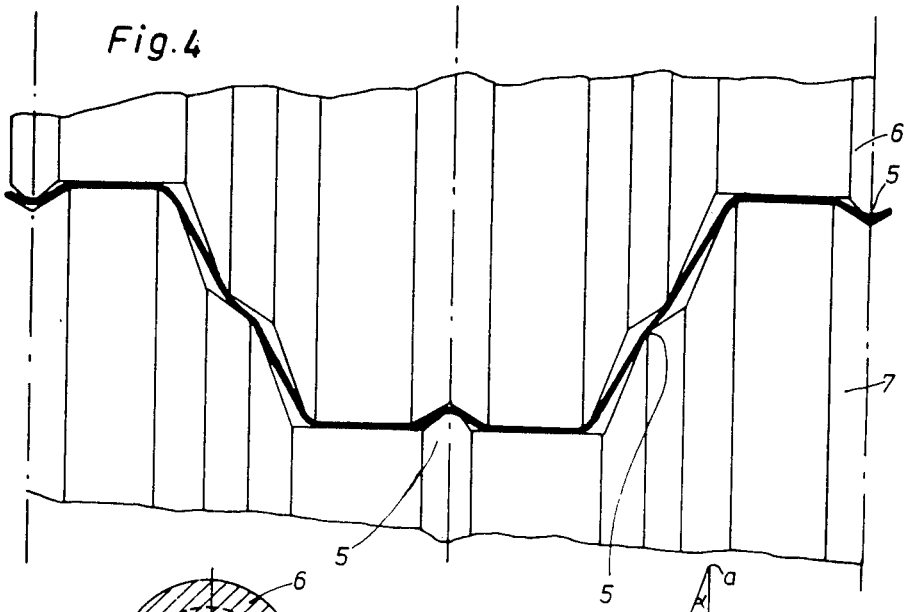
Fig.2
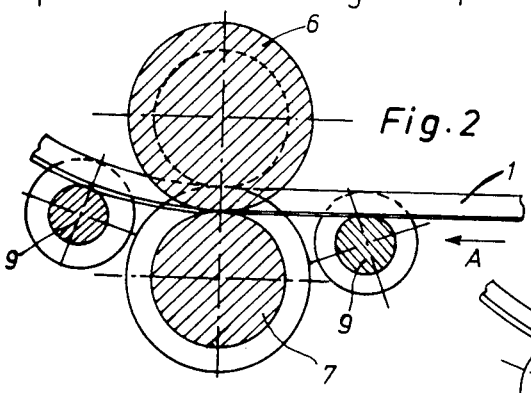
Fig.3
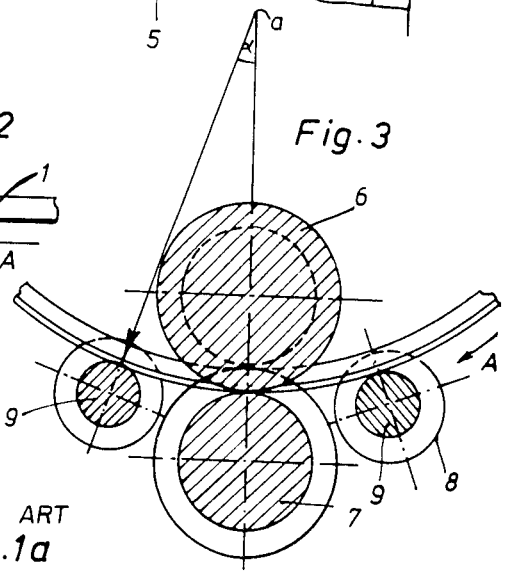
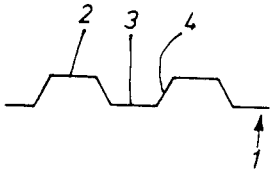
PRIOR ART
Fig.1a
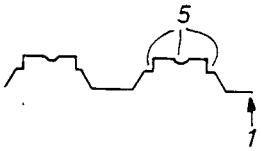
Fig.1b

METHOD FOR BENDING SHEETS

This is a continuation of U.S. Ser. No. 243,942, filed Feb. 26, 1981, now abandoned.

This invention relates to a process of bending sheet metal having a sectional shape which is continuous in one direction, such as trapezium-section or rectangular-section sheet metal elements.

The bending of sheet metal sections, particularly so-called trapezium-section sheet metal elements, bent about axes at right angles to the height of the section, is hardly possible at all or involves a high expenditure. This is due to the fact that the bending gives rise to tensile and compressive stresses and the sheet metal elements to be bent resist tensile stresses but do not resist substantial compressive stresses. For instance, when it is attempted to bend a trapezium-section sheet metal element in the conventional manner, the sheet metal element will buckle in the portion subjected to compressive stresses and the size of such buckled portions will be within tolerable limits only when the bending radius exceeds about 25 mm.

On the other hand there is a strong demand for sheet metal elements which are bent with radii that are much less than 25 meters, for instance for roof trusses, where radii of bend of 5 to 10 meters or even smaller radii of bend are desired.

In a known process of bending trapezium-section sheet metal elements a press is used to emboss spaced apart depressions into the sheet metal element, which depressions extend transversely to the height of the section. Whereas the trapezium-section sheet element can actually be bent in this manner, the process has severe disadvantages. On the one hand, the process is very slow and expensive because it is intermittent rather than continuous. On the other hand, the sheet metal element bent in accordance with the known process can hardly be stressed because owing to the transverse depressions it can easily be folded together like the bellows of an accordion.

It is an object of the invention to provide for the bending of sheet metal sections, particularly trapezium-section sheet metal elements, a process which can be carried out quickly and simply and results in bent sheet metal elements of high quality. Specifically, the bending should not reduce the strength of the sheet metal elements.

In a process of the kind described first hereinbefore, that object can be accomplished according to the invention in that longitudinal beads are formed or existing beads are reinforced in the sheet metal element as it is bent at least in the region in which the bending results in an upsetting of material, i.e., in the region in which the sheet metal element is subjected to compressive stress.

In this way, sheet metal sections can be bent in a surprisingly simple manner and at high velocity. The sheet metal elements have the same strength before and after the bending.

It is pointed out at this juncture that unbent planar trapezoidal-section sheet metal elements having longitudinal beads are known in the art. Such longitudinal beads in the inner and outer chords serve to increase the moment of inertia and moment of resistance. The process according to the invention may be used to bend also sheet metal elements which have been provided with beads before; for that purpose, such beads may be en-larged or additional, new beads may be formed.

When it is desired to bend trapezium-section sheet metal elements consisting of inner and outer booms with respect to the axis of curvature, and webs connecting said booms, at least one bead is formed in each of the inner booms and of the webs. As compressive stresses arise during the bending operation only in the inner booms and the inner web portions, it will be sufficient to provide beads in these regions.

In many cases, however, it is desirable for reasons of manufacturing technology and of economy to provide beads at the centre of each of the outer and inner booms and in each web adjacent to the center plane of the sheet metal element.

The process according to the invention can be carried out to special advantage by an apparatus comprising a driven pair of rolls, which comprises a stationary roll and a roll which is adjustable to define a nip with the stationary roll, and at least one bending roll, disposed or behind the pair of rolls and adjustable to define a nip therewith, wherein all rolls have a profile which is similar to the sectional shape of the sheet metal element, and at least the rolls of the pair of rolls have profile corresponding to that of the longitudinal beads to be formed in the sheet metal element.

The invention and further advantages and features thereof will now be described more fully with reference to illustrative embodiments shown on the accompanying drawings, in which FIGS. 1*a* and *b* are sectional views respectively showing a trapezium-section sheet metal element before and after its bending, FIGS. 2 and 3 are diagrammatic side elevations showing apparatus for carrying out the process according to the invention and FIG. 4 shows a portion of a trapezium-section sheet metal element as it is bent between two profiled rolls.

The trapezium-section sheet metal element 1 shown in FIG. 1*a* has a conventional sectional shape and is to be bent about an axis which is normal to the height of the section. With reference to the axis of curvature a (FIG. 4), inner booms 2 and outer booms 3 can be distinguished and are interconnected by webs 4, which constitute the non-parallel sides of the trapezium. When that sheet metal element 1 is bent about the axis of curvature a, which is not shown in FIG. 1 and should be imagined to lie on the drawing above the sheet metal element and to extend parallel to the latter and at right angles to the height of the section, compressive stresses will arise in the inner booms 2 and in that portion of the webs which is nearer to the axis of curvature a. These compressive stresses cause the sheet metal element to be upset and distorted.

In the process according to the invention, such upsetting is avoided in that continuous longitudinal beads 5 are formed in the sheet metal element as it is bent; these beads 5 are formed in the region in which compressive stresses arise; these beads are indicated in FIG. 1*b*. As the beads formed in the sheet metal element as it is bent will take up the deformations resulting from upsetting, the bent sheet metal element is free from bulges or the like and is satisfactory in appearance and of higher strength.

Sheet metal sections can be bent by the process according to the invention by means of a machine which comprises profiling rollers and is shown, e.g., in FIGS. 2 and 3 to comprise a pair of rolls 6, 7, which are preceded by a first bending roll 8 and succeeded by a second bending roll 9. All rolls consist of profiled rolls and have a profile which conforms to the sectional shape of the sheet metal element. At least the rolls 6, 7 of the pair are also profiled in accordance with the beads to be formed. This is clearly apparent from FIG. 4, which shows a trapezium-section sheet metal element 1 between the rolls 6 and 7 of the pair of rolls. In the sheet metal element shown in FIG. 4, the beads 5 are formed exactly at the center of the outer and inner booms and of the webs.

With further reference to FIGS. 2 and 3, the upper roll 6 may have a stationary axis and be driven and the lower roll 7 may be movable toward the roll 6 so that the roll nip can be adjusted. The sheet metal element 1 moves from the right in the direction A around the bending roll 8, which does not define a rolling up in this case, and then enters the nip between rolls 6, 7. Subsequently the sheet metal element moves around the bending roll 9, which defines a rolling nip that determines the radius of bend. The roll nip and the profiles of the rolls are so dimensioned that the upsetting which during the bending is effected adjacent to the beads contributes to the formation of the beads. As a result, the inevitable upsetting of the material during the bending occurs in exactly defined zones in the form of beads.

As is apparent from FIG. 3, the sheet metal element can be prebent by the first bending roll 8 and can be bent to the final radius of bend by means of the second bending roll 9. On the other hand, two bending stations of the kind described may be connected one behind the other, or one and the same sheet metal element may be passed through the apparatus twice or several times if each bending roll is adjusted to different positions every time. What method is most favourable in a given case will depend on the nature and gauge of the sheet metal and on the desired radius of bend.

It has been found that trapezium-section sheet metal elements made of steel or aluminium and having gauges of and above 0.6 mm and a section height up to 200 mm can be bent by the process according to the invention with a radius of bend even below 450 cm. In some cases the formation of a plurality of juxtaposed beads may be of advantage.

Although the process according to the invention has been described with reference to a trapezium-section sheet metal element, the process may be applied to other sectional shapes, such as corrugated sheet metal elements, sheet metal elements having a triangular or rectangular section, etc., It is merely essential that the beads are formed during the bending in the regions in which compressive stresses arise during bending.

The embodiments of the invention in which an exclusive property or privilege is claimed are defined as follows:

1. A process for bending a sheet metal element into an elongated self-supporting sheet metal construction panel, having inside and outside surfaces, a longitudinal axis and a transverse sectional shape continuous in the direction of the longitudinal axis, said transverse sectional shape comprising at least one trapezium section having rectilinearly arranged walls forming inner and outer beams and webs connecting the beams with the webs forming nonparallel walls and a web connecting an inner and outer beam, the height of the trapezium section being the distance between an inner and an outer beam, comprising the steps of providing a pair of rolls including a stationary roll and an adjustable roll, and at least one adjustable bending roll disposed in front or behind said pair of rolls, each of said rolls having a profile surface which corresponds to the sectional shape of the sheet metal, feeding said panel through said rolls and bending said sheet metal panel, from one end to the other in its longitudinal direction to bend, the beams and webs of said panel continuously about an axis normal to the height of said trapezium section thereby placing said sheet metal element in compressive stress, and simultaneously forming continuous longitudinal beads within said panel parallel to said longitudinal axis between those beams and webs in which the bending occurs by said pair of rolls and where upsetting of material subjected to compressive stress occurs, existing beads in any of those beams and webs being enlarged and reinforced in a form-locking manner.

2. The process of claim 1, characterized in that a bead is formed at the center of each of the outer and inner beams and in each web of the sheet metal.

* * * * *